US007147751B2

(12) United States Patent
Shannon et al.

(10) Patent No.: US 7,147,751 B2
(45) Date of Patent: Dec. 12, 2006

(54) WIPING PRODUCTS HAVING A LOW COEFFICIENT OF FRICTION IN THE WET STATE AND PROCESS FOR PRODUCING SAME

(75) Inventors: Tom G. Shannon, Neenah, WI (US); Dave Soerens, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 77 days.

(21) Appl. No.: 10/325,461

(22) Filed: Dec. 20, 2002

(65) Prior Publication Data

US 2004/0121158 A1 Jun. 24, 2004

(51) Int. Cl.
*D21H 21/14* (2006.01)
*D21H 17/53* (2006.01)

(52) U.S. Cl. ..... 162/135; 162/158; 162/109; 162/164.1; 162/164.6; 162/168.1; 162/168.2; 162/179; 428/413; 404/402

(58) Field of Classification Search ..... 162/109, 162/111–113, 123–129, 158, 135, 164.1, 162/168.1, 179, 537.4, 340, 537.5, 168.2, 162/164.6; 428/537.5, 340, 341, 403, 405, 428/413; 424/402, 443; 427/361, 391
See application file for complete search history.

(56) References Cited

U.S. PATENT DOCUMENTS 3,078,849 A 2/1963 Morse
3,556,932 A 1/1971 Coscia et al.
3,556,933 A 1/1971 Williams et al.
3,585,104 A 6/1971 Kleinert
3,700,623 A 10/1972 Keim
3,772,076 A 11/1973 Keim
3,855,158 A 12/1974 Petrovich et al.
3,899,388 A 8/1975 Petrovich et al.
4,028,172 A 6/1977 Mazzarella
4,100,324 A 7/1978 Anderson et al.
4,129,528 A 12/1978 Petrovich et al.
4,147,586 A 4/1979 Petrovich et al.
4,158,594 A 6/1979 Becker et al.
4,208,459 A 6/1980 Becker et al.
4,222,921 A 9/1980 Van Eenam
4,353,981 A 10/1982 Noda et al.
4,459,317 A 7/1984 Lambert
4,501,641 A 2/1985 Hirakawa et al.
4,514,345 A 4/1985 Johnson et al.
4,528,239 A 7/1985 Trokhan
4,589,873 A * 5/1986 Schwartz et al. ..... 604/265
4,594,130 A 6/1986 Chang et al.
4,604,313 A 8/1986 McFarland
4,642,257 A 2/1987 Creasy et al.
4,666,437 A 5/1987 Lambert
4,775,725 A 10/1988 DePasquale et al.
4,793,898 A 12/1988 Laamanen et al.
4,835,211 A 5/1989 Noda et al.
4,846,932 A 7/1989 Karita et al.
4,856,502 A 8/1989 Ersfeld et al.
4,902,553 A * 2/1990 Hwang et al. ..... 428/156
4,919,828 A 4/1990 Childers
4,943,460 A * 7/1990 Markle et al. ..... 428/36.9
4,959,125 A 9/1990 Spendel
4,973,680 A 11/1990 Billmers
5,004,791 A 4/1991 Billmers
5,049,235 A 9/1991 Barcus et al.
5,098,522 A 3/1992 Smurkoski et al.
5,135,516 A 8/1992 Sahatjian et al.
5,160,789 A 11/1992 Barcus et al.
5,173,208 A 12/1992 Chung et al.
5,260,171 A 11/1993 Smurkoski et al.
5,262,007 A 11/1993 Phan et al.
5,264,082 A 11/1993 Phan et al.
5,275,700 A 1/1994 Trokhan
5,279,767 A 1/1994 Phan et al.
5,298,335 A 3/1994 Reed et al.
5,300,192 A 4/1994 Hansen et al.
5,312,522 A 5/1994 Van Phan et al.
5,328,565 A 7/1994 Rasch et al.
5,334,289 A 8/1994 Trokhan
5,350,624 A 9/1994 Georger et al.
5,352,515 A * 10/1994 Jarrett et al. ..... 428/357
5,354,829 A 10/1994 Swisher et al.
5,360,419 A 11/1994 Chen et al.
5,427,696 A 6/1995 Phan et al.
5,431,786 A 7/1995 Rasch et al.
5,442,016 A * 8/1995 Jarrett et al. ..... 525/415

(Continued)

FOREIGN PATENT DOCUMENTS

DE 19537088 A1 4/1997

(Continued)

OTHER PUBLICATIONS

PCT Search Report for PCT/US03/34899, Jun. 15, 2004.

(Continued)

*Primary Examiner*—José A. Fortuna
(74) *Attorney, Agent, or Firm*—Dority & Manning, P.A.

(57) ABSTRACT

Base sheets are disclosed having a reduced coefficient of friction in the wet state. In accordance with the present invention, the base sheets can be treated with a high molecular weight polyethylene oxide, a derivatized polyethylene oxide or an acrylate copolymer containing polyethylene moieties. The base sheet can be single ply or multi-ply. The base sheet can be a tissue product, such as a facial tissue, a bath tissue, or a paper towel. Alternatively, the base sheet can be a pre-moistened wipe.

75 Claims, 2 Drawing Sheets

U.S. PATENT DOCUMENTS 5,443,899 A 8/1995 Barcus et al.
5,496,624 A 3/1996 Stelljes, Jr. et al.
5,500,277 A 3/1996 Trokhan et al.
5,503,714 A 4/1996 Reiners et al.
5,514,523 A 5/1996 Trokhan et al.
5,554,467 A 9/1996 Trokhan et al.
5,566,724 A 10/1996 Trokhan et al.
5,580,356 A 12/1996 Taylor
5,595,628 A 1/1997 Gordon et al.
5,601,530 A 2/1997 Nielsen et al.
5,609,727 A 3/1997 Hansen et al.
5,624,790 A 4/1997 Trokhan et al.
5,628,876 A 5/1997 Ayers et al.
5,635,191 A * 6/1997 Roe et al. ..... 424/402
5,635,239 A 6/1997 Chen et al.
5,688,855 A 11/1997 Stoy et al.
5,698,074 A 12/1997 Barcus et al.
5,718,804 A 2/1998 Jansen et al.
5,731,087 A 3/1998 Fan et al.
5,739,249 A 4/1998 Reiners et al.
5,770,711 A 6/1998 Greene et al.
5,846,383 A 12/1998 Träubel et al.
5,990,333 A 11/1999 Allen et al.
5,993,972 A * 11/1999 Reich et al. ..... 428/423.1
6,007,627 A 12/1999 Barnholtz
6,020,071 A 2/2000 Watson
6,054,020 A 4/2000 Goulet et al.
6,071,450 A 6/2000 Topolkaraev et al.
6,096,152 A 8/2000 Anderson et al.
6,103,064 A 8/2000 Asplund et al.
6,117,438 A 9/2000 Topolkaraev et al.
6,117,947 A 9/2000 Wang et al.
6,117,974 A 9/2000 Gilon et al.
6,172,177 B1 1/2001 Wang et al.
6,224,714 B1 5/2001 Schroeder et al.
6,235,155 B1 5/2001 Schroeder et al.
6,274,667 B1 8/2001 Shannon et al.
6,287,418 B1 9/2001 Schroeder et al.
6,342,297 B1 1/2002 LaBrach
6,385,667 B1 5/2002 Estakhri et al.
6,432,270 B1 8/2002 Liu et al.
6,440,437 B1 8/2002 Krzysik et al.
6,666,952 B1 12/2003 Dilts et al.
6,670,521 B1 * 12/2003 Noda et al. ..... 604/364
6,706,410 B1 3/2004 Horenziak et al.
6,994,770 B1 * 2/2006 Shannon et al. ..... 162/168.1
2001/0055609 A1 * 12/2001 Shantz et al. ..... 424/443
2002/0132540 A1 9/2002 Soerens et al.
2002/0192407 A1 * 12/2002 Hendrix et al. ..... 428/34.3
2003/0056917 A1 * 3/2003 Jimenez ..... 162/158
2003/0136531 A1 * 7/2003 Edwards et al. ..... 162/111
2004/0040681 A1 * 3/2004 Ohashi et al. ..... 162/158
2004/0052834 A1 * 3/2004 West et al. ..... 424/443
2004/0118541 A1 * 6/2004 Shannon et al. ..... 162/164.1
2004/0121158 A1 * 6/2004 Shannon et al. ..... 428/413
2006/0027349 A1 * 2/2006 Shannon et al. ..... 162/164.1

FOREIGN PATENT DOCUMENTS

EP 0314128 A1 5/1989
EP 0347176 B1 12/1989
EP 0517890 B1 12/1992
EP 0582166 A1 2/1994
EP 0541511 B1 8/1997
EP 0540506 B1 9/1997
EP 0878179 A2 11/1998
EP 0803012 B1 6/1999
EP 1013825 A1 6/2000
GB 1600963 10/1981
WO WO 8909246 A1 10/1989
WO WO 9713922 A1 4/1997
WO WO 9956689 A1 11/1999
WO WO 99/67325 A1 12/1999
WO WO 0992252 A2 4/2000
WO WO 0056977 A1 9/2000
WO WO 02066089 A2 8/2002
WO WO 02066089 A3 8/2002

OTHER PUBLICATIONS

Abstract of Japanese Patent No. 60171190, Apr. 9, 1985.
U.S. Appl. No. 10/325,668, filed Dec. 20, 2002, Shannon et al.
Abstract of Japanese Patent 04041800 A2, Feb. 12, 1992.
Abstract of Japanese Patent 03109195 B2, Nov. 13, 2000.
McGraw-Hill Dictionary of Scientific and Technical Terms, Fifth Edition, Sybil P. Parker-Editor in Chief, definition of Polyethylene glycol, 1994.
Internet Screen Print, Wikipedia Free Encyclopedia, definition of Polyethylene glycol, Sep. 13, 2005.

* cited by examiner

WIPING PRODUCTS HAVING A LOW COEFFICIENT OF FRICTION IN THE WET STATE AND PROCESS FOR PRODUCING SAME

BACKGROUND OF THE INVENTION

Many textile materials have an increased coefficient of friction on their surfaces when wet. For example, clothing such as shirts and other garments are harder to put on or take off when wet or when going on over wet skin. In a like manner, many wiping products, such as facial tissues, bath tissues, paper towels, and the like, also experience this same phenomenon. For instance, tissue products typically have more drag across the surface when wet than when in the dry state. Increased drag can be noticed even if the tissue product has a smooth surface and/or has been chemically treated so as to have a very low coefficient of friction in the dry state. Thus, a tissue that is used in the wet state may have an actual tactile sensory feel that is quite different than the same tissue used in the dry state. This increased coefficient of friction may not only be less desirable to the user but may also lead to a high level of slough when wet.

As such, a need currently exists for a wiping product that has a reduced coefficient of friction in the wet state.

SUMMARY OF THE INVENTION

Tissue products are disclosed having an improved feel when wet. The tissue products include a base sheet comprising pulp fibers. The base sheet may have a bulk density of at least 2 cc/g. In accordance with the present invention, a wet anti-friction composition is applied to at least one side of the base sheet. The wet anti-friction composition is applied in an amount sufficient for the treated side of the base sheet to have a wet static or dynamic coefficient of friction that is no more than 10 percent greater than the dry static or dynamic coefficient of friction of the treated side. In other embodiments, for instance, the anti-friction composition is applied in an amount sufficient for the treated side of the base sheet to have a wet coefficient of friction that is no more than 3 percent greater than the dry coefficient of friction. In fact, in one embodiment, the treated side of the base sheet can have a wet coefficient of friction that is actually less than the dry coefficient of friction.

The wet anti-friction composition of the present invention can contain various polymeric materials. For instance, the anti-friction composition can comprise a polyethylene oxide having a molecular weight of greater than about 20,000, particularly greater than about 50,000, and more particularly from about 400,000 to about 2 million. In an alternative embodiment, the anti-friction composition comprises a derivatized polyethylene oxide in which the polyethylene oxide has a molecular weight of greater than about 20,000. In still another embodiment of the present invention, the wet anti-friction composition comprises an addition copolymer derived from ethylenically unsaturated monomers containing pendant alkylene oxide moieties.

Particular examples of anti-friction agents useful in the present invention include derivatized polyethylene oxides having silanol functional groups. In other embodiments, the anti-friction composition contains a poly(ethylene glycol) alkyl ether methacrylate or 2-hydroxy ethyl methacrylate.

The anti-friction composition can be topically applied to the base sheet or can be used to pre-treat fibers that are used to form the base sheet. In general, the wet anti-friction composition is applied to the base sheet in an amount from about 0.03 percent to about 3 percent by weight of fibers contained in the base sheet.

The tissue product formed in accordance with the present invention can be a facial tissue, a bath tissue, a paper towel, an industrial wiper, and the like. In an alternative embodiment, the present invention is directed to treating pre-moistened wipes, including pre-moistened bath tissue.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
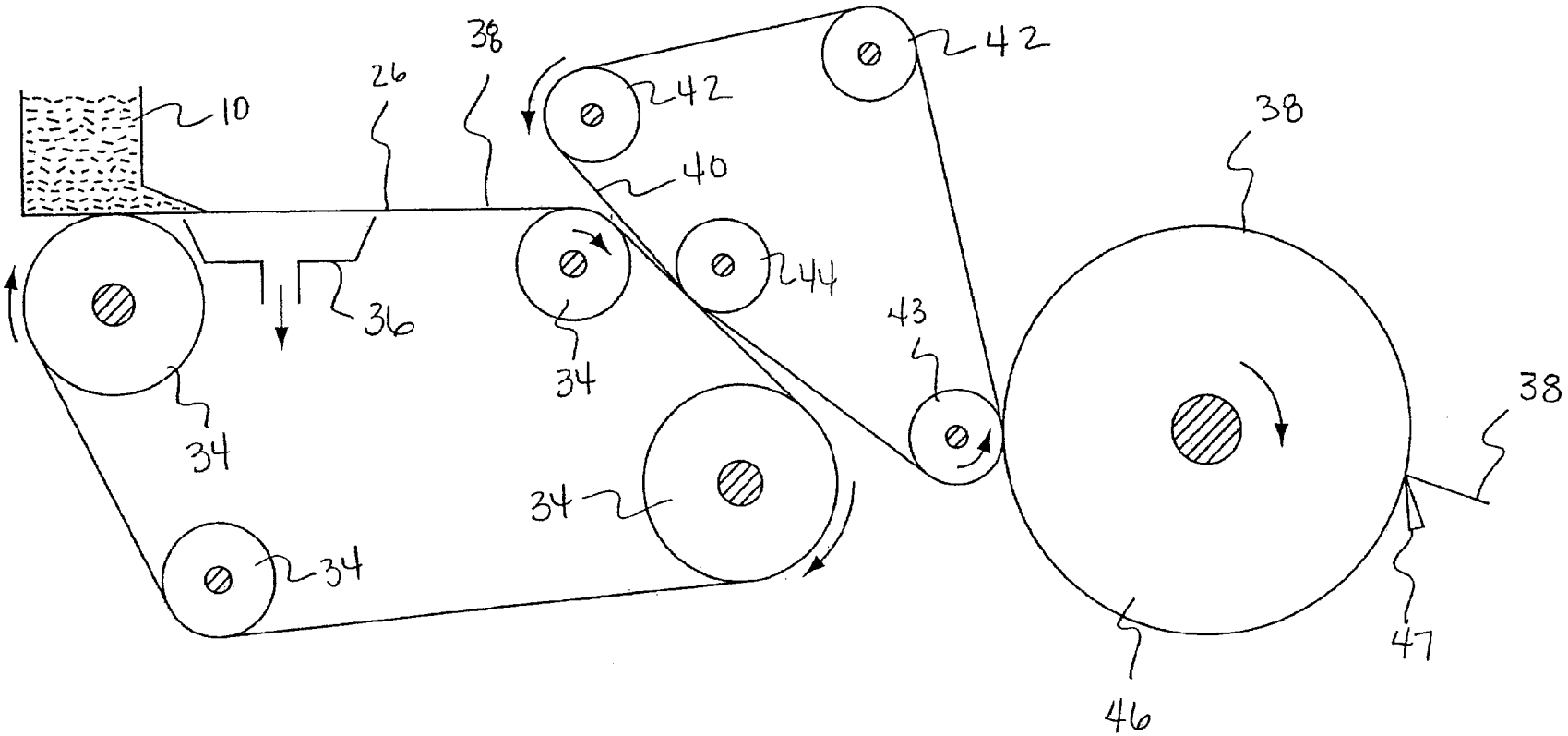
FIG. 1 is a schematic diagram of one embodiment of a process for forming paper webs that can be used in the present invention.

Repeat use of reference characters in the present specification and drawings is intended to represent same or analogous features or elements of the present invention.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to treating wiping products with a wet anti-friction composition that reduces the coefficient of friction of a surface of the wiping product when the material is in the wet state. Of particular advantage, the anti-friction composition can also be hydrophilic. Thus, once incorporated into a wiping product, the anti-friction composition does not appreciably alter the absorbency rate or absorbent capacity of the product. By reducing the coefficient of friction in the wet state, wiping products made in accordance with the present invention have a more soothing feel against a person's skin when in use. For example, facial tissues and bath tissues treated in accordance with the present invention will feel softer and smoother to the touch when used in the wet state.

In addition to facial tissues and bath tissues, however, various other wiping products can be produced according to the present invention. For example, the present invention is also directed to the construction of paper towels, industrial wipers, and the like. Further, properties of pre-moistened wipes including pre-moistened bath tissue can also be improved when treated in accordance with the present invention.

The present inventors have discovered that various different compounds and chemical agents can be used in the composition of the present invention for improving the wet properties of the wiping product. In general, the composition contains polyethylene oxide or a compound containing polyethylene oxide moieties. For example, in one embodiment, the anti-friction composition of the present invention may contain a high molecular weight polyethylene oxide. In another embodiment, the composition of the present invention can contain a derivatized polyethylene oxide. In still another embodiment of the present invention, the composition contains an addition copolymer or polymer derived from ethylenically unsaturated monomers wherein at least one monomer comprises a pendant polyethylene oxide moiety. This third class of compounds can include, for instance, cationic acrylamide copolymers with ethylenically unsaturated monomers having pendant ethylene oxide functionality.

Once a wiping product is treated in accordance with the present invention, the coefficient of friction of the wiping product in the wet state can be very similar to the coefficient of friction of the wiping product in the dry state. For example, wiping products treated in accordance with the present invention can have a static or dynamic coefficient of friction in the wet state that is no more than about 10 percent greater than the dry static or dynamic coefficient of friction of the treated product. For example, in one embodiment, the wet static or dynamic coefficient of friction of the treated product can be no more than about 3 percent greater than the dry static or dynamic coefficient of friction, and particularly can have a wet static or dynamic coefficient of friction that is no greater than the dry static or dynamic coefficient of friction. In some embodiments, it is even believed that wiping products can be produced having a wet coefficient of friction that is actually less than the dry coefficient of friction of the treated base sheet.

As described above, one category of compounds that can be used in accordance with the present invention include high molecular weight polyethylene oxides. Polyethylene oxides used according to the present invention can have the following general formula:

$$R^1O—(CH_2CH_2O)_nR^2$$

wherein $R^1$ and $R^2$ are hydrogen or organofunctional groups. $R^1$ and $R^2$ can be the same or different.

In general, the high molecular weight polyethylene oxide can have a molecular weight of greater than about 20,000, and particularly greater than about 50,000. As used herein, molecular weight can be determined by rheological measurements. In one embodiment, the high molecular polyethylene oxide can have a molecular weight of from about 400,00 to about 2,000,000.

High molecular weight polyethylene oxides are available from various commercial sources. Examples of polyethylene oxide resins that can be used in the present invention are commercially available from the Union Carbide Corporation and are sold under the trade designations POLYOX N-205, POLYOX-N-750, POLYOX WSR N-10 and POLYOX WSR N-80. The above four products are believed to have molecular weights of from about 100,000 to about 600,000 (g-mol). Polyethylene oxide resins may optionally contain various additives such as plasticizers, processing aids, rheology modifiers, antioxidants, UV light stabilizers, pigments, colorants, slip additives, antiblock agents, etc.

When treating a base sheet with a high molecular weight polyethylene oxide in accordance with the present invention, the high molecular weight polyethylene oxide, for most applications, is applied topically. In general, any suitable topical application process can be used to apply the composition. For example, in one embodiment, the polyethylene oxide can be combined with a solvent such as an alcohol or with water to form a solution and applied to a base sheet. When applied as a solution, the composition can be sprayed onto the base sheet or printed onto the base sheet. Any suitable printing device, for instance, may be used. For example, an ink jet printer or a rotogravure printing machine may be used. When applied as a solution, the polyethylene oxide can be contained within the solution in an amount from about 0.5 percent to about 50 percent by weight. It should be understood, however, that more or less polyethylene oxide can be contained in the solution depending on the molecular weight of the polyethylene oxide and the type of application process that is used. In an alternative embodiment, a viscous aqueous or neat solution of the polyethylene oxide may be applied via a melt blowing or modified melt blowing technique. For example, the polyethylene oxide viscous aqueous solution may be extruded from a die head such as UFD spray tips, such as those available from ITW-Dynatec located in Henderson, Tenn.

In one embodiment, the anti-friction composition containing the high molecular weight polyethylene oxide can be heated prior to or during application to a base web. Heating the composition can lower the viscosity for facilitating application. In one embodiment, the polyethylene oxide can be heated and extruded onto a base sheet. Any suitable extrusion device can be used, such as a meltblown die. Extruding the composition containing the polyethylene oxide onto a base sheet can provide some advantages in applications where the viscosity of the composition is relatively high. For instance, in one embodiment, the polyethylene oxide can be applied in a neat form when extruded onto the base sheet.

When topically applied, the anti-friction composition containing polyethylene oxide can be applied to one side or to both sides of the base sheet. Further, the composition can be applied to cover 100 percent of the surface area of the base sheet or can be applied in a pattern that includes treated areas and untreated areas. For example, if applied in a pattern, the composition can cover from about 20 percent to about 99 percent of the surface area of one side of the base sheet, such as from about 40 percent to about 90 percent of the surface area.

In general, the polyethylene oxide composition can be applied to the base sheet at different points in the production of the wiping product. For example, if the wiping product is a paper product, the polyethylene oxide composition can be applied while the sheet is still wet or after the sheet has been dried during formation. Alternatively, the polyethylene oxide composition can be applied after formation of the base sheet during a converting operation.

The second category of compounds that can be used in the wet anti-friction composition of the present invention include derivatized polyethylene oxides, particularly derivatized high molecular weight polyethylene oxides. For example, polyethylene oxides as described above can be derivatized and used in this embodiment.

A derivatized polyethylene oxide may be formed by reacting a polyethylene oxide with one or more monomers to provide a functional group on the polyethylene oxide polymer. The derivative groups can be placed in the backbone of the polyethylene oxide or can be pendent groups. The derivative groups can be present in the polymer in an amount from about 0.5 percent to about 25 percent by weight, such as from about 0.5% to about 10% by weight.

In one embodiment, a derivatized polyethylene oxide for use in the present invention can be formed by grafting monomers onto the polyethylene oxide. The grafting is accomplished by mixing polyethylene oxide with one or more monomers and an initiator and applying heat. Such treated polyethylene oxide compositions are disclosed in U.S. Pat. No. 6,172,177 to Wang et al, which is incorporated herein by reference.

In this embodiment, a variety of polar vinyl monomers may be useful in the practice of the present invention. The term "monomer" as used herein includes monomers, oligomers, polymers, mixtures of monomers, oligomers, and/or polymers, and any other reactive chemical species which is capable of covalent bonding with polyethylene oxide. Ethylenically unsaturated polar vinyl monomers that may be used to derivatize a polyethylene oxide can include as a functional group hydroxyl, carboxyl, amino, carbonyl, halo, thiol, sulfonic, sulfonate, amine, amide, aldehyde, epoxy, silanol, azetidinium groups and the like.

In one embodiment, the unsaturated monomers include acrylates and methacrylates. Such monomers include 2-hydroxyethyl methacrylate (referred to as HEMA) and poly (ethylene glycol) methacrylate. For example, a poly(ethylene glycol) alkyl ether methacrylate can be used, such as poly(ethylene glycol) ethyl ether methacrylate or poly(ethylene glycol) methyl ether methacrylate.

When forming a derivatized polyethylene oxide in this embodiment, an initiator may be useful in forming the polymer. The initiator can generate free radicals when subjected to energy, such as the application of heat.

Compounds containing an O—O, S—S, or N═N bond may be used as thermal initiators. Compounds containing O—O bonds; i.e., peroxides, are commonly used as initiators for graft polymerization. Such commonly used peroxide initiators include: alkyl, dialkyl, diaryl and arylalkyl peroxides such as cumyl peroxide, t-butyl peroxide, di-t-butyl peroxide, dicumyl peroxide, cumyl butyl peroxide, 1,1-di-t-butyl peroxy-3,5,5-trimethylcyclohexane, 2,5-dimethyl-2,5-di(t-butylperoxy)hexane, 2,5-dimethyl-2,5-bis(t-butylperoxy)hexane, 2,5-dimethyl-,5-bis(t-butylperoxy)hexyne-3 and bis(a-t-butyl peroxyisopropylbenzene); acyl peroxides such as acetyl peroxides and benzoyl peroxides; hydroperoxides such as cumyl hydroperoxide, t-butyl hydroperoxide, p-methane hydroperoxide, pinane hydroperoxide and cumene hydroperoxide; peresters or peroxyesters such as t-butyl peroxypivalate, t-butyl peroctoate, t-butyl perbenzoate, 2,5-dimethylhexyl-2,5-di(perbenzoate) and t-butyl di(perphthalate); alkylsulfonyl peroxides; dialkyl peroxymonocarbonates; dialkyl peroxydicarbonates; diperoxyketals; ketone peroxides such as cyclohexanone peroxide and methyl ethyl ketone peroxide. Additionally, azo compounds such as 2,2'-azobisisobutyronitrile abbreviated as AIBN, 2,2'-azobis(2,4-dimethylpentanenitrile) and 1,1'-azobis(cyclohexanecarbonitrile) may be used as the initiator. Graft copolymers that are useful in the subject coatings have been demonstrated in the following Examples by the use of a liquid, organic peroxide initiator available from R. T. Vanderbilt Company, Inc. of Norwalk, Conn., sold under the trade designation VAROX DBPH peroxide which is a free radical initiator and comprises 2,5-bis(tert butylperoxy)-2,5-dimethyl hexane along with smaller amounts of di(tert butylperoxide). Other initiators may also be used, such as LUPERSOL® 101 and LUPERSOL® 130 available from Elf Atochem North America, Inc. of Philadelphia, Pa.

In one embodiment, the formation of a derivatized polyethylene oxide for use in the present invention can be illustrated as follows:

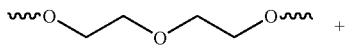

-continued

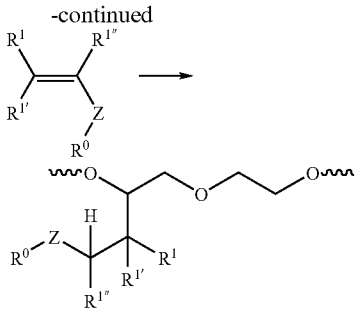

where $R^1$, $R^{1'}$, $R^{1''}$ are independently H or a $C_{1-4}$ alkyl, Z is any bridging radical whose purpose is to incorporate the $R^0$ moiety into the ethylenically unsaturated monomer, and $R^0$ is any group capable of forming covalent and/or hydrogen bonds with cellulose or with the polymer itself. Examples of suitable Z groups include but are not limited to —O—, —S—, —OOC—, —COO—, —HNOC—, —CONH. Suitable $R^0$ functional groups include amine, amide, carboxyl, hydroxyl, aldehyde, epoxy, silanol, and azetidinium groups. The materials may incorporate a second ethylenically unsaturated monomer whose purpose is to provide a charge or basis for charge development within the polymer. The charge is preferably cationic but may be anionic or amphoteric. Incorporation of such charge now makes the material substantive to cellulose in a wet end application.

In one particular embodiment, the polyethylene oxide polymer is grafted with an amount of an organic moiety that includes a group that reacts with water to form a silanol group. For example, one such functional group that can react with water to form a silanol group is a trialkoxy silane functional group. The trialkoxy silane functional group can have the following structure:

8

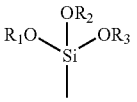

wherein $R_1$, $R_2$ and $R_3$ are the same or different alkyl groups, each independently having 1 to 6 carbon atoms.

In forming derivatized polyethylene oxides that form a silanol group, the polyethylene oxide can be reacted with a monomer containing, for instance, a trialkoxy silane functional group as illustrated above. For example, in one embodiment, the monomer is an acrylate or methacrylate, such as methacryloxypropyl trimethoxy silane. Methacryloxypropyl propyl trimethoxy silane is commercially available from Dow Corning out of Midland, Mich. under the trade designation Z-6030 Silane.

Other suitable monomers containing a trialkoxy silane functional group include, but are not limited to, methacryloxyethyl trimethoxy silane, methacryloxypropyl triethoxy silane, methacryloxypropyl tripropoxy silane, acryloxypropylmethyl dimethoxy silane, 3-acryloxypropyl trimethoxy silane, 3-methacryloxypropylmethyl diethoxy silane, 3-methacryloxypropylmethyl dimethoxy silane, and 3-methacryloxypropyl tris(methoxyethoxy) silane. However, it is contemplated that a wide range of vinyl and acrylic monomers having trialkoxy silane functional groups or a moiety that reacts easily with water to form a silanol group, such as a chlorosilane or an acetoxysilane, provide the desired effects to PEO and are effective monomers for grafting in accordance with the copolymers of the present invention.

When reacting a polyethylene oxide with methacryloxypropyl trimethoxy silane to form a derivatized polyethylene oxide, the equation can be represented as follows:

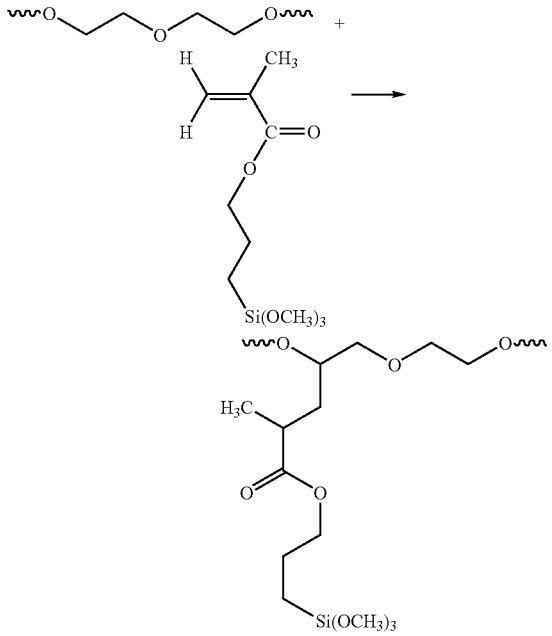

When treating base webs with a wet anti-friction composition containing a derivatized polyethylene oxide, the composition can be applied to the base web topically or can be incorporated into the base web by being premixed with the fibers that are used to form the web. When applied topically, the derivatized polyethylene oxide can be applied using any of the techniques described above with respect to topically applying a high molecular weight polyethylene oxide. If placed into a solution and applied to a base web, it is believed that almost any liquid can be used as a solvent. For instance, the solvent can be an organic solvent, such as an alcohol, ketone, aldehyde, alkane, alkene, aromatic, or mixtures thereof. Alternatively, the solvent can be water. For example, many derivatized polyethylene oxides can be dissolved in water under high shear.

When the derivatized polyethylene oxide is applied to fibers prior to formation of a base web, the derivatized polyethylene oxide can be formulated such that the composition forms a bond with the fibers during formation of the web. In particular, one or more monomers can be reacted with the polyethylene oxide during formation of the derivatized polyethylene oxide to provide charge or basis for a charge development within the polymer. The charge is typically cationic, but can also be anionic or amphoteric. The presence of a charge makes the material substantive to cellulose fibers when applied to the fibers in the wet end of the process.

For example, in one embodiment, the derivatized polyethylene oxide can be added to an aqueous suspension of fibers that are used to form a paper web. The derivatized polyethylene oxide can bond to the fibers and become incorporated into a web formed from the fibers. If the derivatized polyethylene oxide does not bond with the fibers, a substantial amount of the composition may be removed from the fibers when the aqueous suspension of fibers are formed into a web and drained.

The third category of compounds that can be used in the wet anti-friction composition of the present invention include addition copolymers or polymers derived from ethylenically unsaturated monomers wherein at least one monomer comprises a pendant polyethylene oxide moiety. The method by which the polymers are made is not overly critical to the invention. The polymers may be made by any of the methods broadly known in the art for preparing addition polymers from ethylenically unsaturated monomers. The individual monomers making up the polymer may be arranged in a random or block pattern or a mixture of random and block patterns. The weight average Mw of the polymers can vary but specifically have a weight average Mw greater than about 20,000 and most specifically greater than about 50,000. The polyalkylene oxide moiety pendant group has a degree of polymerization greater than 2, more specifically greater than 3 and most specifically greater than about 5. That is, the pendant polyalkylene oxide group will contain 2 or more polyalkylene oxide units in the pendant chain.

Such compounds will have the general formula:

$$\{[Q^1]_a[Q^2]_b[Q^3]_c\}_w$$

wherein:

a and b are integers greater than or equal to 0 c is an integer>0 w is an integer greater than or equal to 1

$Q^1$ is a monomer unit containing a functionality capable of hydrogen or covalently bonding with cellulose or any other polar or non-polar monomer not containing a pendant polyalkylene oxide functionality.

$Q^2$ is a monomer unit containing a charge functionality.

$Q^3$ is a monomer unit or mixture of monomer units containing pendant polyalkylene oxide functionality wherein said pendant polyalkylene oxide functionality has a degree of polymerization greater than about 2.

The ratio of c to (a+b+c) may vary such that the weight ratio of $Q^3$ to $[Q^1+Q^2+Q^3]$ is from about 5 to 100%, more specifically from about 10 to 100% and most specifically from about 20 to 100%.

In a specific embodiment the charge functionality $Q^2$ is cationic. Examples of suitable monomers for incorporating the charge functionality include but is not limited to [2-(methacryloyloxy)ethyl] trimethylammonium methosulfate (METAMS); dimethyldiallyl ammonium chloride (DMDAAC); 3-acryloamido-3-methyl butyl trimethyl ammonium chloride (AMBTAC); trimethylamino methacrylate; vinyl benzyl trimethyl ammonium chloride (VBTAC); 2-[(acryloyloxy)ethyl] trimethylammonium chloride; [2-(methacryloyloxy)ethyl] trimethylammonium chloride.

In another embodiment, such compounds include cationic acrylamide copolymers with ethylenically unsaturated monomers having pendant ethylene oxide functionality. Such materials particularly have a molecular weight of greater than about 20,000, such as greater than about 50,000. These compounds can be represented as follows:

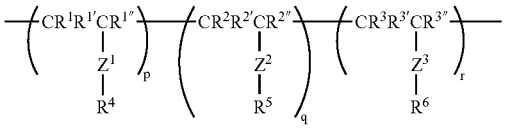

wherein $R^{1'}$, $R^{1''}$, $R^2$, $R^{2'}$, $R^{2''}$, $R^3$, $R^{3'}$, $R^{3''}$ are independently H, or $C_{1-4}$ alkyl. $Z^1$, $Z^2$, $Z^3$ are any bridging radicals, the same or different whose purpose is to incorporate the $R^i$ moieties into the ethylenically unsaturated polymer backbone. Suitable radicals include but are not limited to —CONH—, NHCO—, —O—, —S—, —$CH_2$—, -aryl-, —COO—, —OOC— and the like. $R^4$ can be any functional group incorporated as part of an ethylenically unsaturated monomer, $R^5$ is any cationically charged species, and $R^6$ is a polyoxyethylene or polyoxyalkylene derivative of the formula —$(CHR^7CHR^8O)_s$—$(CH_2CH_2O)_v$–Rwherein $R^7$, $R^8$, $R^9$, $R^{10}$ are independently $C_{1-4}$ alkyl groups; s, t, v are integers such that t>0 and s+t+v>3. $R^{11}$ can be any suitable terminating radical including H, alkyl, substituted alkyl, aryl and substituted aryl. Values of p & q are ≧0 while the value or r>0. The percent of $R^6$ in the polymer should range from 5 to 100 weight percent, particularly from 10 to 100 weight percent and still more particularly from about 20 to 100 weight percent of the total polymer. In theory, any -$[Q]^j$-elements such $[Q]^j$ elements representing any ethylenically unsaturated monomer unit can be built into the polymer without interfering with the perceived tactile properties as long as the $R^6$ units are present in the polymer at the stated level.

In another embodiment the cationic group of the polymer is derived from incorporation of a diallydimethylammonium cationic monomer. Incorporated in this manner the cationic functionality in the polymer will have the structure:

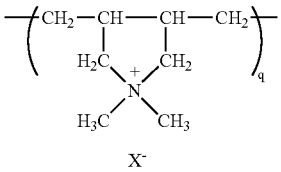

Wherein $X^-$ is any suitable anion including but not limited to chloride, bromide, fluoride, iodide, methylsulfate, ethylsulfate and the like.

The above polymer can be a block copolymer or a random copolymer. The compounds are water dispersible or water-soluble. Further, the compounds can be substantive to cellulose fibers and, therefore, can be applied topically to a base web or can be applied to the fibers prior to formation of the base web, such as being incorporated into the wet end of a paper making process. For example, in one embodiment, when incorporated into an aqueous suspension of fibers during formation of a base web, the compound can be added in an amount from about 5 to about 0 lbs per ton of fibers. Depending upon the compound used, however, greater or lesser amounts may be added.

For topical applications, p and q in the formula above can be zero. For wet end application, however, p can be zero but q is greater than zero. In the formula above, the upper limits of p, q and r are defined by the molecular weight of the polymer.

Particular acrylate copolymers containing polyethylene oxide moieties that can be used in this embodiment include 2-hydroxyethyl methacrylate copolymers and poly(ethylene glycol) alkyl ether methacrylate copolymers, such as poly (ethylene glycol) ethyl ether methacrylate copolymers or poly(ethylene glycol) methyl ether methacrylate copolymers.

In one embodiment, the wet anti-friction composition can include the following compound:

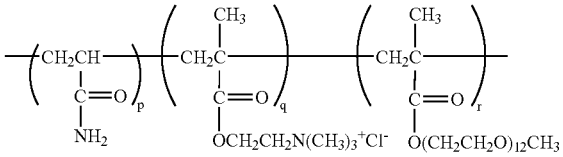

In one particular embodiment of the above polymer, p=0.8, q=0.1 and r=0.1. In this embodiment, the monomers can be incorporated in random fashions. Such a polymer can be made from commercially available monomers by standard polymerization techniques known to those skilled in the art.

In general, any suitable base web may be treated in accordance with the present invention for reducing the wet coefficient of friction on the surface of the web. For example, in one embodiment, the base sheet can be a tissue product, such as a bath tissue, a facial tissue, a paper towel, an industrial wiper, and the like. Tissue products typically have a bulk density of at least 2 cc/g. The tissue products can contain one or more plies and can be made from any suitable types of fiber.

Fibers suitable for making paper webs comprise any natural or synthetic cellulosic fibers including, but not limited to non-woody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988, to Laamanen et al.; U.S. Pat. No. 4,594,130, issued Jun. 10, 1986, to Chang et al.; and U.S. Pat. No. 3,585,104, issued Jun. 15,1971, to Kleinert. Useful fibers can also be produced by anthraquinone pulping, exemplified by U.S. Pat. No. 5,595,628, issued Jan. 21, 1997, to Gordon et al. A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Pulpex®, available from Hercules, Inc. (Wilmington, Del.). Any known bleaching method can be used. Synthetic cellulose fiber types include rayon in all its varieties and other fibers derived from viscose or chemically modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more-specifically still at least 400, and most specifically at least 500.

Other papermaking fibers that can be used in the present invention include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

In general, any process capable of forming a paper web can also be utilized in the present invention. For example, a papermaking process of the present invention can utilize creping, wet creping, double creping, embossing, wet pressing, air pressing, through-air drying, creped through-air drying, uncreped through-air drying, air layering, hydroentangling, as well as other steps known in the art.

Also suitable for products of the present invention are tissue sheets that are pattern densified or imprinted, such as the tissue sheets disclosed in any of the following U.S. Pat. No.: 4,514,345, issued on Apr. 30, 1985, to Johnson et al.; U.S. Pat. No. 4,528,239, issued on Jul. 9, 1985, to Trokhan; U.S. Pat. No. 5,098,522, issued on Mar. 24, 1992; U.S. Pat. No. 5,260,171, issued on Nov. 9, 1993, to Smurkoski et al.; U.S. Pat. No. 5,275,700, issued on Jan. 4, 1994, to Trokhan; U.S. Pat. No. 5,328,565, issued on Jul. 12, 1994, to Rasch et al.; U.S. Pat. No. 5,334,289, issued on Aug. 2, 1994, to Trokhan et al.; U.S. Pat. No. 5,431,786, issued on Jul. 11, 1995, to Rasch et al.; U.S. Pat. No. 5,496,624, issued on Mar. 5, 1996, to Steltjes, Jr. et al.; U.S. Pat. No. 5,500,277, issued on Mar. 19, 1996, to Trokhan et al.; U.S. Pat. No. 5,514,523, issued on May 7, 1996, to Trokhan et al.; U.S. Pat. No. 5,554,467, issued on Sep. 10, 1996, to Trokhan et al.; U.S. Pat. No. 5,566,724, issued on Oct. 22, 1996, to Trokhan et al.; U.S. Pat. No. 5,624,790, issued on Apr. 29, 1997, to Trokhan et al.; and, U.S. Pat. No. 5,628,876, issued on May 13, 1997, to Ayers et al., the disclosures of which are incorporated herein by reference to the extent that they are non-contradictory herewith. Such imprinted tissue sheets may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet superposed over the deflection conduits was deflected by an air pressure differential across the deflection conduit to form a lower-density pillow-like region or dome in the tissue sheet.

For example, referring to FIG. 1, one embodiment of a process for producing a base web that may be used in accordance with the present invention is illustrated. The process illustrated in the figure depicts a wet-lay process, although, as described above, other techniques for forming the base web of the present invention may be used.

As shown in FIG. 1, the web-forming system includes a headbox 10 for receiving an aqueous suspension of fibers. Headbox 10 spreads the aqueous suspension of fibers onto a forming fabric 26 that is supported and driven by a plurality of guide rolls 34. A vacuum box 36 is disposed beneath forming fabric 26 and is adapted to remove water from the fiber furnish to assist in forming a web.

From forming fabric 26, a formed web 38 is transferred to a second fabric 40, which may be either a wire or a felt. Fabric 40 is supported for movement around a continuous path by a plurality of guide rolls 42. Also included is a pick up roll 44 designed to facilitate transfer of web 38 from fabric 26 to fabric 40. The speed at which fabric 40 can be driven is approximately the same speed at which fabric 26 is driven so that movement of web 38 through the system is consistent. Alternatively, the two fabrics can be run at different speeds, such as in a rush transfer process, in order to increase the bulk of the webs or for some other purpose.

From fabric 40, web 38, in this embodiment, is pressed onto the surface of a rotatable heated dryer drum 46, such as a Yankee dryer, by a press roll 43. Web 38 is lightly pressed into engagement with the surface of dryer drum 46 to which it adheres, due to its moisture content and its preference for the smoother of the two surfaces. As web 38 is carried through a portion of the rotational path of the dryer surface, heat is imparted to the web causing most of the moisture contained within the web to be evaporated.

Web 38 is then removed from dryer drum 46 by a creping blade 47. Creping web 38 as it is formed reduces internal bonding within the web and increases softness.

In an alternative embodiment, instead of wet pressing the base web 38 onto a dryer drum and creping the web, the web can be through-air dried. A through-air dryer accomplishes the removal of moisture from the base web by passing air through the web without applying any mechanical pressure.

Figure 2:
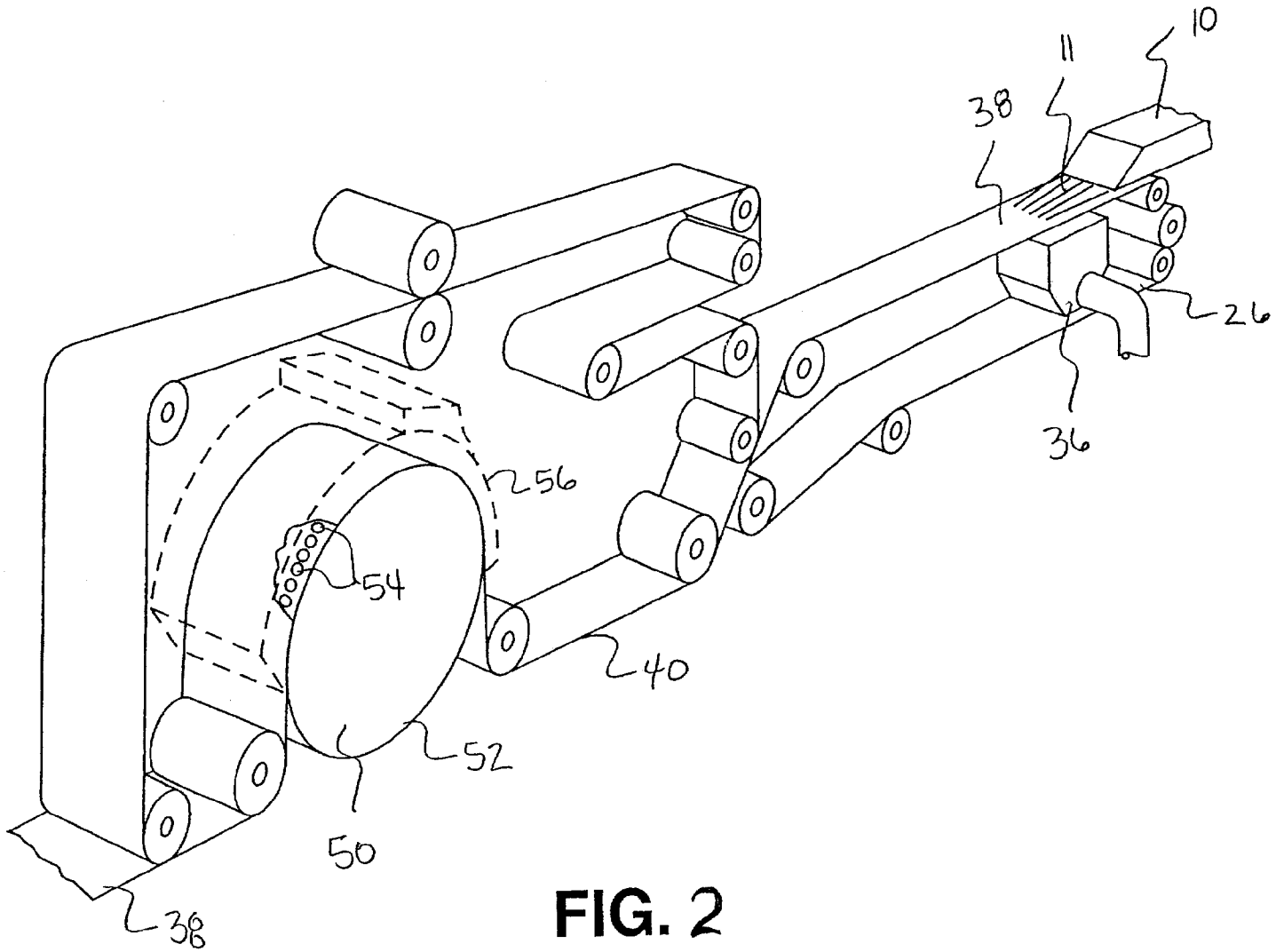
FIG. 2 is a perspective view of another alternative embodiment of a process for producing paper webs that may be used in the present invention.

For example, referring to FIG. 2, an alternative embodiment for forming a base web for use in the process of the present invention containing a through-air dryer is illustrated. As shown, a dilute aqueous suspension of fibers is supplied by a headbox 10 and deposited via a sluice 11 in uniform dispersion onto a forming fabric 26 in order to form a base web 38.

Once deposited onto the forming fabric 26, water is removed from the web 38 by combinations of gravity, centrifugal force and vacuum suction depending upon the forming configuration. As shown in this embodiment, and similar to FIG. 1, a vacuum box 36 can be disposed beneath the forming fabric 26 for removing water and facilitating formation of the web 38.

From the forming fabric 26, the base web 38 is then transferred to a second fabric 40. The second fabric 40 carries the web through a through-air drying apparatus 50. The through-air dryer 50 dries the base web 38 without applying a compressive force in order to maximize bulk. For example, as shown in FIG. 2, the through-air drying apparatus 50 includes an outer rotatable cylinder 52 with perforations 54 in combination with an outer hood 56. Specifically, the fabric 40 carries the web 38 over the upper portion of the through-air drying apparatus outer cylinder 52.

Heated air is drawn through perforations 54 which contacts the web 38 and removes moisture. In one embodiment, the temperature of the heated air forced through the perforations 54 can be from about 170° F. to about 500° F.

In one embodiment, the second fabric 40 can be moving at a slower speed than the forming fabric 26 in a process known as rush transfer. The base web is transferred from the forming fabric to the dryer fabric (optionally a transfer fabric can be interposed between the forming fabric and the dryer fabric) traveling at a slower speed than the forming fabric in order to impart increased stretch into the web. Transfer can be carried out with the assistance of a vacuum shoe and a fixed gap or space between the forming fabric and the dryer fabric or a kiss transfer to avoid compression of the wet web. The second fabric 40 can be traveling at a speed, for instance, that is from about 5 percent to about 60 percent slower than the forming fabric.

The tissue sheet containing the cationic synthetic co-polymers of the present invention may be blended or layered sheets, wherein either a heterogeneous or homogeneous distribution of fibers is present in the z-direction of the sheet. At times it may be advantageous to add the wet friction reducing agent to all the fibers in the sheet. At other times it may be advantageous to add the wet friction reducing agent only selective fibers in the sheet, such methods being well known to those skilled in the art. In a specific embodiment of the present invention the tissue sheet is a layered tissue sheet comprising two or more layers comprising distinct hardwood and softwood layers, wherein the wet friction reducing agents of the present invention are added to only the hardwood fibers. In another specific embodiment the tissue product is a single ply tissue product, comprising either a blended or layered sheet, wherein the wet friction reducing agent is selectively applied to the exterior surface or exterior layers of the tissue ply. In another specific embodiment, the tissue product is a multi-ply tissue product wherein the wet friction reducing agents of the present invention are selectively applied to the two exterior facing surfaces of the multi-ply tissue product or to the exterior facing layer of each tissue ply.

Optional Chemical Additives

Optional chemical additives may also be added to the aqueous papermaking furnish or to the embryonic tissue sheet to impart additional benefits to the product and process and are not antagonistic to the intended benefits of the present invention. The following materials are included as examples of additional chemicals that may be applied to the tissue sheet with the cationic synthetic co-polymers and cationic synthetic co-polymer additives of the present invention. The chemicals are included as examples and are not intended to limit the scope of the present invention. Such chemicals may be added at any point in the papermaking process, such as before or after addition of the cationic synthetic co-polymers and/or cationic synthetic co-polymer additives of the present invention. They may also be added simultaneously with the cationic copolymers and/or cationic synthetic co-polymer additives, either blended with the cationic synthetic co-polymers and/or cationic synthetic co-polymer additives of the present invention or as separate additives.

Charge Control Agents

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are micro-particle systems containing high surface area, high anionic charge density materials.

Strength Agents

Wet and dry strength agents may also be applied to the tissue sheet. As used herein, "wet strength agents" refer to materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph, and other body exudates.

Any material that when added to a tissue sheet or sheet results in providing the tissue sheet with a mean wet geometric tensile strength:dry geometric tensile strength ratio in excess of about 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50% of its original wet strength after exposure to water for a period of at least five minutes. Temporary wet strength agents are those which show about 50% or less than, of their original wet strength after being saturated with water for five minutes. Both classes of wet strength agents find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the fibers.

Permanent wet strength agents will typically provide a more or less long-term wet resilience to the structure of a tissue sheet. In contrast, the temporary wet strength agents will typically provide tissue sheet structures that had low density and high resilience, but would not provide a structure that had long-term resistance to exposure to water or body fluids.

Wet and Temporary Wet Strength Agents

The temporary wet strength agents may be cationic, nonionic or anionic. Such compounds include PAREZ™ 631 NC and PAREZ® 725 temporary wet strength resins that are cationic glyoxylated polyacrylamide available from Cytec Industries (West Paterson, N.J.). This and similar resins are described in U.S. Pat. No. 3,556,932, issued on Jan. 19, 1971, to Coscia et al. and U.S. Pat. No. 3,556,933, issued on Jan. 19, 1971, to Williams et al. Hercobond 1366, manufactured by Hercules, Inc., located at Wilmington, Del., is another commercially available cationic glyoxylated polyacrylamide that may be used in accordance with the present invention. Additional examples of temporary wet strength agents include dialdehyde starches such as Cobond® 1000 from National Starch and Chemical Company and other aldehyde containing polymers such as those described in U.S. Pat. No. 6,224,714, issued on May 1, 2001, to Schroeder et al.; U.S. Pat. No. 6,274,667, issued on Aug. 14, 2001, to Shannon et al.; U.S. Pat. No. 6,287,418, issued on Sep. 11, 2001, to Schroeder et al.; and, U.S. Pat. No. 6,365,667, issued on Apr. 2, 2002, to Shannon et al., the disclosures of which are herein incorporated by reference to the extent they are non-contradictory herewith.

Permanent wet strength agents comprising cationic oligomeric or polymeric resins can be used in the present invention. Polyamide-polyamine-epichlorohydrin type resins such as KYMENE 557H sold by Hercules, Inc., located at Wilmington, Del., are the most widely used permanent wet-strength agents and are suitable for use in the present invention. Such materials have been described in the following U.S. Pat. No. 3,700,623, issued on Oct. 24, 1972, to Keim; U.S. Pat. No. 3,772,076, issued on Nov. 13, 1973, to Keim; U.S. Pat. No. 3,855,158, issued on Dec. 17, 1974, to Petrovich et al.; U.S. Pat. No. 3,899,388, issued on Aug. 12, 1975, to Petrovich et al.; U.S. Pat. No. 4,129,528, issued on Dec. 12, 1978, to Petrovich et al.; U.S. Pat. No. 4,147,586, issued on Apr. 3, 1979, to Petrovich et al.; and, U.S. Pat. No. 4,222,921, issued on Sep. 16, 1980, to van Eenam. Other cationic resins include polyethylenimine resins and aminoplast resins obtained by reaction of formaldehyde with melamine or urea. It is often advantageous to use both permanent and temporary wet strength resins in the manufacture of tissue products with such use being recognized as falling within the scope of the present invention.

Dry Strength Agents

Dry strength agents may also be applied to the tissue sheet without affecting the performance of the disclosed cationic synthetic co-polymers of the present invention. Such materials used as dry strength agents are well known in the art and include but are not limited to modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. It may at times, however, be beneficial to blend the dry strength agent with the cationic synthetic co-polymers of the present invention and apply the two chemicals simultaneously to the tissue sheet.

Softening Agents

Softening agents, sometimes referred to as debonders, can be used to enhance the softness of the tissue product and such softening agents can be incorporated with the fibers before, during or after formation of the aqueous suspension of fibers. Such agents can also be sprayed or printed onto the web after formation, while wet. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 ( di(hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

Additional softeners may be applied topically to enhance the surface feel of the product. An especially preferred topical softener for this application is polysiloxane. The use of polysiloxanes to soften tissue sheets is broadly taught in the art. A large variety of polysiloxanes are available that are capable of enhancing the tactile properties of the finished tissue sheet. Any polysiloxane capable of enhancing the tactile softness of the tissue sheet is suitable for incorporation. Examples of suitable polysiloxanes include but are not limited to linear polydialkyl polysiloxanes such as the DC-200 fluid series available from Dow Corning, Inc., Midland, Mich. as well as the organofunctional polydimethyl siloxanes such as the preferred amino functional polydimethyl siloxanes. Examples of suitable polysiloxanes include those described in U.S. Pat. No. 6,054,020, issued on Apr. 25, 2000, to Goulet et al. and U.S. Pat. No. 6,432,270, issued on Aug. 13, 2002, to Liu et al., the disclosures of which are herein incorporated by reference to the extent that they are non-contradictory herewith. Additional exemplary aminofunctional polysiloxanes are the Wetsoft CTW family manufactured and sold by Wacker Chemie, Munich, Germany.

Miscellaneous Agents

It may be desirable to treat the tissue sheet with additional types of chemicals.

Such chemicals include, but are not limited to, absorbency aids usually in the form of cationic, anionic, or non-ionic surfactants, humectants and plasticizers such as low molecular weight polyethylene glycols and polyhydroxy compounds such as glycerin and propylene glycol.

In general, the cationic synthetic co-polymers of the present invention may be used in conjunction with any known materials and chemicals that are not antagonistic to its intended use. Examples of such materials and chemicals include, but are not limited to, odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, polysiloxanes and the like. A wide variety of other materials and chemicals known in the art of papermaking and tissue production may be included in the tissue sheets of the present invention including lotions and other materials providing skin health benefits such as aloe extract and tocopherols such as vitamin E.

The basis weight of paper webs used in the present invention can vary depending upon the particular application. In general, for most applications, the basis weight can be from about 6 gsm to about 140 gsm, and particularly from about 10 gsm to about 80 gsm. For example, bath tissues and facial tissues typically have a basis weight of less than about 40 gsm. Paper towels, on the other hand, typically have a basis weight of greater than about 30 gsm.

In addition to dry wiping products, the anti-friction composition of the present invention can also be applied to pre-moistened wiping products or wet wipes which can include pre-moistened bath tissue.

The wet wipes of the present invention comprise a single layer or a layered base sheet that contains a liquid. The liquid is typically any solution which can be absorbed into the wet wipe base sheet and may include any suitable components which provide the desired wiping properties. Typically, the components include water, emollients, surfactants, fragrances, preservatives, chelating agents, pH buffers or combinations thereof as are well known to those skilled in the art. The liquid may also contain certain lotions and/or medicaments. The emulsion composition is designed to provide improved skin health benefits, such as enhanced barrier function and protection of the skin.

The amount of the oil-in-water emulsion composition contained within each wet wipe may vary depending upon the type of material being used to provide the wet wipe or wipe-type product, the type of container being used to store the wet wipes, and the desired end use of the wet wipe. Generally, each wet wipe or wipe-type product can contain from about 100 to about 600 weight percent and desirably from about 250 to about 450 weight percent liquid based on the dry weight of the wipe for improved wiping.

Each wet wipe is generally rectangular in shape and may have any suitable unfolded width and length. Typically, each individual wet wipe is arranged in a folded configuration and stacked one on top of the other to provide a stack of wet wipes. Such folded configurations are well known to those skilled in the art and include c-folded, z-folded, quarter-folded configurations and the like. The stack of folded wet wipes may be placed in the interior of a container, such as a plastic tub, to provide a package of wet wipes for eventual sale to the consumer. Alternatively, the wet wipes may include a continuous strip of material which has perforations between each wipe and which may be arranged in a stack or wound into a roll for dispensing.

The materials of the base sheet, single or multi-layered, of the wet wipe or the wipe-type product of the present invention may be varied to provide different physical properties. The different physical properties which a layer may be configured to provide by selecting the appropriate materials include softness, resiliency, strength, flexibility, integrity, toughness, absorbency, liquid retention, thickness, tear resistance, surface texture, drapability, hand, wettability, wicking ability and the like and combinations thereof. The wipe can be configured to provide all desired physical properties within one layer or configured to provide only specific physical properties within individual layers of a multi-layered wipe. For example, the wet wipes may include at least one layer of material that is configured to provide strength and resilience to the wet wipe and at least one other layer which is configured to provide a soft, gentle wiping surface to the wet wipe. Desirably, the wet wipes provide a soft wiping surface for contact with the skin.

The layer or layers of the wet wipe or wipe-type products can be made from a variety of materials including meltblown materials, coform materials, air-laid materials, bonded-carded web materials, hydroentangled materials, spunbond materials and the like and can comprise synthetic or natural fibers. Examples of natural fibers suitable for use in the present invention include cellulosic fibers such as wood pulp fibers, cotton fibers, flax fibers, jute fibers, silk fibers and the like. Examples of thermoplastic polymeric fibers suitable for use with the present invention include polyolefins such as polypropylene and polyethylene, polyamides, and polyesters such as polyethylene terephthalate. Alternative synthetic fibers which may be suitable include staple nylon and rayon fibers. The layer or layers of the wet wipe or wipe-type products can be woven or nonwoven materials.

If a layer of the base sheet is a combination of polymeric and natural fibers, such as polypropylene and cellulosic fibers, the relative percentages of the polymeric fibers and natural fibers in the layer can vary over a wide range depending on the desired characteristics of the wet wipes. For example, the layer may comprise from about 20 to about 95 weight percent, desirably from about 20 to about 60 weight percent, and more desirably from about 30 to about 40 weight percent of polymeric fibers based on the dry weight of the layer. Such a layer of polymeric and natural fibers may be manufactured by any method known to those skilled in the art.

Generally, it is desirable that such a layer be formed by a coform process for a more uniform distribution of the polymeric and natural fibers within the layer. Such coform layers are manufactured generally as described in U.S. Pat. No. 4,100,324 to Anderson et al. which issued Jul. 11,1978; U.S. Pat. No. 4,604,313 to McFarland et al. which issued Aug. 5, 1986; and U.S. Pat. No. 5,350,624 to Georger et al. which issued Sep. 27, 1994; which are herein incorporated by reference to the extent they are consistent herewith.

Typically, such coform layers comprise a gas-formed matrix of thermoplastic polymeric meltblown microfibers, such as, for example, polypropylene microfibers, and cellulosic fibers, such as, for example, wood pulp fibers. A coform layer is formed by initially forming at least one primary air stream containing the synthetic or polymeric fibers and merging the primary stream with at least one secondary stream of natural or cellulosic fibers. The primary and secondary streams are merged under turbulent conditions to form an integrated stream containing a thorough, homogeneous distribution of the different fibers. The integrated air stream is directed onto a forming surface to air form the layer of material. A multiplicity of these coform layers can then be formed in succession to provide a web of multiple coform layers.

The base sheet for the wet wipes or wipe-type products may have a total basis weight of from about 10 to about 120 grams per square meter, such as from about 40 to about 90 grams per square meter. The basis weight of the layered base sheet may vary depending upon the desired end use of the wet wipe or wipe-type products.

The amount of the wet anti-friction composition of the present invention that is applied to the base sheet depends on various factors. For instance, the amount applied depends on the base sheet being treated, the particular polymer contained within the anti-friction composition, the desired results, and the manner in which the composition is applied. In general, however, the polyethylene oxide polymers identified above can be added to a base web in an amount from about 0.03 percent to about 3 percent by weight of the fibers. When applied topically, the composition can be applied to a single side or to both sides. Further, the composition can be applied to cover 100 percent of the surface area of the base sheet or can be applied in a pattern that leaves untreated areas on the base sheet.

In general, the anti-friction composition of the present invention can be mixed with other additives as desired and applied to a base sheet or to fibers that are to be made into a base sheet. For example, it is believed that the anti-friction composition of the present invention can be mixed with debonders, softeners, lotions, wet strength agents, topical additives, and the like.

As described above, the polyethylene oxide polymers for use in the present invention are generally hydrophilic and therefore do not interfere with the absorbency characteristics of the base sheet. When applied, the anti-friction composition reduces the coefficient of friction of the base sheet in the wet state. It has been discovered that the static coefficient of the friction of the base sheet in the wet state or the dynamic coefficient of friction of the base sheet in the wet state are substantially reduced when a base sheet is treated in accordance with the present invention. For example, a treated base sheet can have a wet coefficient of friction that is no more than 10 percent greater than the dry coefficient of friction of the treated sheet, particularly no greater than about 3 percent of the dry coefficient of friction of the base sheet, and in one embodiment, the wet coefficient of friction of the base sheet is less than the dry coefficient of friction.

Basis Weight Determination (Tissue)

The basis weight and bone dry basis weight of the tissue sheet specimens was determined using a modified TAPPI T410 procedure. As is basis weight samples were conditioned at 23° C.±1° C. and 50±2% relative humidity for a minimum of 4 hours. After conditioning a stack of 16—3"× 3" samples was cut using a die press and associated die. This represents a tissue sheet sample area of 144 $in^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The specimen stack is then weighed to the nearest 0.001 gram on a tared analytical balance. The basis weight in pounds per 2880 $ft^2$ is then calculated using the following equation:

$$\text{Basis weight}=\text{stack wt. in grams}/454*2880$$

The bone dry basis weight is obtained by weighing a sample can and sample can lid the nearest 0.001 grams (this weight is A). The sample stack is placed into the sample can and left uncovered. The uncovered sample can and stack along with the sample can lid is placed in a 105° C.±2° C. oven for a period of 1 hour ±5 minutes for sample stacks weighing less than 10 grams and at least 8 hours for sample stacks weighing 10 grams or greater. After the specified oven time has lapsed, the sample can lid is placed on the sample can and the sample can is removed from the oven. The sample can is allowed to cool to approximately ambient temperature but no more than 10 minutes. The sample can, sample can lid and sample stack are then weighed to the nearest 0.001 gram (this weight is C). The bone dry basis weight in pounds/2880 $ft^2$ is calculated using the following equation:

$$\text{Bone Dry } BW=(C-A)/454*2880$$

Dry Tensile (Tissue)

The Geometric Mean Tensile (GMT) strength test results are expressed as grams-force per 3 inches of sample width. GMT is computed from the peak load values of the MD (machine direction) and CD (cross-machine direction) tensile curves, which are obtained under laboratory conditions of 23.0° C.±1.0° C., 50.0±2.0% relative humidity, and after the tissue sheet has equilibrated to the testing conditions for a period of not less than four hours. Testing is conducted on a tensile testing machine maintaining a constant rate of elongation, and the width of each specimen tested was 3 inches. The "jaw span" or the distance between the jaws, sometimes referred to as gauge length, is 2.0 inches (50.8 mm). The crosshead speed is 10 inches per minute (254 mm/min.) A load cell or full-scale load is chosen so that all peak load results fall between 10 and 90 percent of the full-scale load. In particular, the results described herein were produced on an Instron 1122 tensile frame connected to a Sintech data acquisition and control system utilizing IMAP software running on a "486 Class" personal computer. This data system records at least 20 load and elongation points per second. A total of 10 specimens per sample are tested with the sample mean being used as the reported tensile value. The geometric mean tensile is calculated from the following equation:

$$GMT=(MD\ \text{Tensile}*CD\ \text{Tensile})^{1/2}$$

To account for small variations in basis weight, GMT values were then corrected to the 18.5 pounds/2880 $ft^2$ target basis weight using the following equation:

$$\text{Corrected } GMT=\text{Measured } GMT*(18.5/\text{Bone Dry Basis Weight})$$

Caliper (Tissue)

The term "caliper" as used herein is the thickness of a single tissue sheet, and may either be measured as the thickness of a single tissue sheet or as the thickness of a stack of ten tissue sheets and dividing the ten tissue sheet thickness by ten, where each sheet within the stack is placed with the same side up. Caliper is expressed in microns. Caliper was measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked tissue sheets. The micrometer used for carrying out T411 om-89 is a Bulk Micrometer (TMI Model 49-72-00, Amityville, N.Y.) or equivalent having an anvil diameter of 4 1/16 inches (103.2 millimeters) and an anvil pressure of 220 grams/square inch (3.3 g kilo Pascals). Bulk can then be determined by taking the caliper and dividing by the bone dry basis weight.

Wet Out Time (Tissue)

The Wet Out Time of a tissue sheet treated in accordance with the present invention is determined by cutting 20 sheets of the tissue sheet sample into 2.5 inch squares. The number of sheets of the tissue sheet sample used in the test is independent of the number of plies per sheet of the tissue sheet sample. The 20 square sheets of the tissue sheet sample are stacked together and stapled at each corner to form a pad of the tissue sheet sample. The pad of the tissue sheet sample is held close to the surface of a constant temperature distilled water bath (23° C.±2° C.), which is the appropriate size and depth to ensure the saturated pad of the tissue sheet sample does not contact the bottom of the water bath container and the top surface of the distilled water of the water bath at the same time, and dropped flat onto the surface of the distilled water, with staple points on the pad of the tissue sheet sample facing down. The time necessary for the pad of the tissue sheet sample to become completely saturated, measured in seconds, is the Wet Out Time for the tissue sheet sample and represents the absorbent rate of the tissue sheet sample. Increases in the Wet Out Time represent a decrease in absorbent rate of the tissue sheet sample.

COF and wet COF testing was conducted using a TMI Slip & Friction tester available from Testing Machines Inc., Ronkonkoma, N.Y. Samples were conditioned at 23° C.±1° C. and 50±2% relative humidity for a minimum of 4 hours prior to testing. Testing was done on a smooth acrylic sheet with a ¼" caulk dam around the perimeter of the acrylic sheet to hold water. The acrylic sheet was placed on the instrument so the sled would move along the acrylic sheet. The sample sheets were cut to a 6.35 cm width and sufficient length to be clamped in the sled. The sample was then placed and secured in the test sled. The method for measuring dry and wet COF values was identical except for the addition of water. For wet COF testing, about 15 cc of water was placed in front of the sled. Sufficient water was added to completely saturate the sheet so as the entire test was run with the sheet completely wet. Where wet strength was lacking, the sheet was backed with clear acrylic tape to prevent disintegration of the sheet in the water. All COF units are in grams. Specific test parameters were as follows:

Delay—5 seconds
Sled—200 grams, 6.35×6.35 cm
Static Duration—2000 ms
Static speed—1cm/min
Kinetic Speed—15.25 cm/min
Kinetic Length—20.5 cm The present invention may be better understood with respect to the following examples.

EXAMPLE NO. 1

A derivatized polyethylene oxide was formed having the following formula:

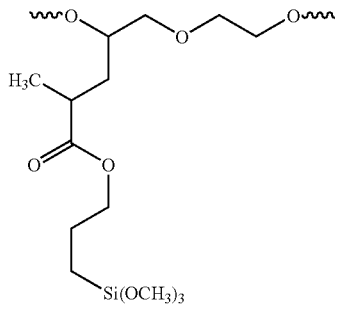

The polyethylene oxide used in this example had a molecular weight of 100,000 and incorporated 6 percent by weight silanol groups.

An aqueous solution containing 1.5 percent of the above silanol functional high molecular weight polyethylene oxide was prepared by dissolving the polymer in distilled water under high shear. A solution was placed in a spray bottle and sprayed on an uncreped through-air dried bath base sheet containing no chemicals. The base sheet was a single ply uncreped through-air dried product having a basis weight of 18.5 pounds per 2,880 sq. ft. The amount of base sheet used was 0.2 grams with 1.0 grams of solution added to the sheet. The sheet was then dried in a convection oven at 120° C. for five minutes.

Upon wetting, enhanced lubricity was noticed.

EXAMPLE NO. 2

High molecular weight polyethylene oxides having molecular weights of 400,000 and 2,000,000 were tested on the same base sheet and according to a similar process as described in Example No. 1. Upon wetting, the treated base sheets were found to have enhanced lubricity.

Low molecular weight polyethylene glycols having a molecular weight of 8,000 and lower were also tested and found not to produce the same lubricity effects.

EXAMPLE NO. 3

An acrylate copolymer containing polyethylene moieties was also tested according to the procedure described in Example No. 1. The acrylate copolymer had the following structure:

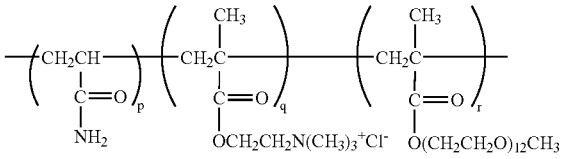

wherein p=0.8, q=0.1 and r=0.1. The monomers were incorporated into the polymer in random fashion.

A base sheet treated with an aqueous composition containing the above polymer was wetted. It was observed that the base sheet had enhanced lubricity.

EXAMPLE NO. 4

An uncreped through-air dried bath base sheet having a basis weight of 18.5 pounds per 2,880 sq. ft. and having a dry tensile strength of about 850 g/3 inches was obtained.

Samples of the base sheet were topically treated with an aqueous solution containing a polyethylene oxide having a molecular weight of 400,000, a polyethylene oxide having a molecular weight of 2,000,000, and a silanol derivatized polyethylene oxide as described in Example No. 1. The samples were treated as described in Example No. 1. After being treated, the samples were dried.

Each of the samples along with an untreated base sheet were then tested for static coefficient of friction of the sheet in the dry state, the static coefficient of friction of the base sheet in the wet state, the kinetic coefficient of friction of the base sheet in the dry state, and the kinetic coefficient of friction of the base sheet in the wet state.

To determine the static coefficient of friction of the dry base sheets, the samples were cut to size and placed on a smooth acrylic sheet with a one-fourth inch caulk dam around the perimeter of the acrylic sheet to hold water. The samples were placed in the test sled.

The sled weighed 200 grams and was 6.35 cm by 6.35 cm. The sheet was tested for 2,000 ms at a static speed of 1 cm per minute.

To determine the static coefficient of friction in the wet state, about 10 to about 20 cubic cm of water was placed in front of the sled. Sufficient water was added to completely saturate the sheet so that the entire test was run with the sheet completely wet. A delay of 5 seconds occurred prior to testing. When the wet strength of the base sheet was lacking, the sheet was backed with clear acrylic tape to prevent disintegration of the sheet in the water.

The kinetic coefficient of friction test was conducted similar to the static coefficient of friction test. The speed during the kinetic test, however, was 15.25 cm per minute. The kinetic length was 20.5 cm.

The following results were obtained:

| Sample No. | Treatment |
|---|---|
| Control | None |
| 1 | Aqueous solution containing polyethylene oxide having a molecular weight of 400,000 |
| 2 | Aqueous solution containing polyethylene oxide having a molecular weight of 2,000,000 |
| 3 | Silanol derivatized polyethylene oxide containing 6% silol groups and a polyethylene oxide having a molecular weight of 100,000 |

| | Control | 1 | 2 | 3 |
|---|---|---|---|---|
| Static COF Dry | 47 | 52 | 55 | 65 |
| Static COF Wet | 67 | 54 | 45 | 56 |
| Kinetic COF Dry | 60 | 53 | 65 | 51 |
| Kinetic COF Wet | 83 | 70 | 80 | 59 |

As shown above, the base sheets treated in accordance with the present invention had a reduced coefficient of friction in the wet state.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A dry tissue product having an improved feel when wet comprising:

a base sheet comprising pulp fibers, the base sheet having a first side and a second and opposite side, the base sheet having a bulk density of at least about 2 cc/g;

a wet anti-friction composition applied to at least one side of the base sheet, the wet anti-friction composition being applied in an amount sufficient for the treated side of the base sheet to have a wet static coefficient of friction that is no more than about 10% greater than the dry static coefficient of friction of the treated side, wherein the wet anti-friction composition comprises a derivatized polyethylene oxide, the polyethylene oxide having a molecular weight of greater than about 20,000.

2. A tissue product as defined in claim 1, wherein the derivatized polyethylene oxide comprises:

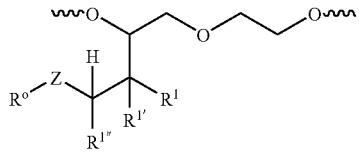

wherein $R^1$, $R^{1'}$, $R^{1''}$ are independently H or a $C_{1-4}$ alkyl;

Z is a bridging radical selected from the groups comprising —O—, —S—, —OOC—, —COO—, —HNOC—, —CONH, and mixtures thereof; and $R^0$ is a moiety containing a functional group selected from the group H, amine, amide, carboxyl, hydroxyl, aldehyde, epoxy, silanol and azetidinium groups, and mixtures thereof.

3. A tissue product as defined in claim 1, wherein the derivatized polyethylene oxide comprises:

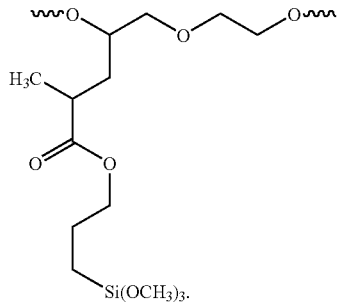

4. A tissue product as defined in claim 1, wherein the derivatized polyethylene oxide has silanol functional groups.

5. A tissue product as defined in claim 1, wherein the derivatized polyethylene oxide forms covalent or ionic bonds with paper fibers.

6. A tissue product as defined in claim 1, wherein the derivatized polyethylene oxide contains from about 0.5 percent to about 25 percent by weight of pendant functional groups.

7. A dry tissue product having an improved feel when wet comprising:

a base sheet comprising pulp fibers, the base sheet having a first side and a second and opposite side, the base sheet having a bulk density of at least about 2 cc/g;

a wet anti-friction composition applied to at least one side of the base sheet, the wet anti-friction composition being applied in an amount sufficient for the treated side of the base sheet to have a wet static coefficient of friction that is no more than about 10% greater than the dry static coefficient of friction of the treated side, wherein the wet anti-friction composition comprises a polymer or copolymer derived from ethylenically unsaturated monomers wherein at least one monomer comprises a pendant polyalkylene oxide moiety.

8. A tissue product of claim 7, wherein the polymer or copolymer has a the structure:

$$-\{-[Q^1]_a-[Q^2]_b-[Q^3]_c-\}_w-$$

wherein:

a and b are integers greater than or equal to 0 c is an integer >0 w is an integer greater than or equal to 1;

$Q^1$ is a monomer unit containing a functionality capable of hydrogen or covalently bonding with cellulose or any other polar or non-polar monomer not containing a pendant polyalkylene oxide functionality;

$Q^2$ is a monomer unit containing a charge functionality;

$Q^3$ is a monomer unit or mixture of monomer units containing pendant polyalkylene oxide functionality wherein said pendant polyalkylene oxide functionality has a degree of polymerization greater than 3; and the ratio of c to (a+b+c) is chosen such that the weight ratio of $Q^3$ to $[Q^1+Q^2+Q^3]$ is from about 5 to 100%.

9. A tissue product as defined in claim 8 wherein the ratio of c to (a+b+c) is chosen such that the weight ratio of $Q^3$ to $[Q^1+Q^2+Q^3]$ is from about 20 to 100%.

10. A tissue product as defined in claim 8 wherein polymer or copolymer has a weight average molecular weight of greater than about 20,000.

11. A tissue product as defined in claim 8 wherein b>0 and $Q^2$ is derived from a monomer unit containing a cationic charge functionality.

12. A tissue product as defined in claim 11 wherein the cationic charge functionality is incorporated via a diallydimethylammonium cationic monomer.

13. A tissue product as defined in claim 7, wherein the polymer or copolymer comprises:

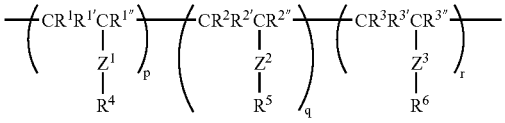

wherein $R^{1'}$, $R^{1''}$, $R^{2'}$, $R^{2'}$, $R^{2''}$, $R^{3'}$, $R^{3'}$, $R^{3''}$ are independently H, or a $C_{1-4}$ alkyl group;

$Z^1$, $Z^2$, $Z^3$ are bridging radicals selected from the group consisting of —CONH—, —NHCO—, —O—, —S—, —CH2—, -aryl-, —COO—or —OOC—, and mixtures thereof; —$R^4$ is any functional group incorporated as part of an ethylenically unsaturated monomer;

$R^5$ is any cationically charged species; and $R^6$ is a polyoxyethylene or polyoxyalkylene derivative of the formula—$(CHR^7CHR^8O)_s$ —$(CH2CH2O)_t$—$(CHR^9CHR^{10}O)_v$—$R^{11}$ wherein $R^7$, $R^8$, $R^9$, $R^{10}$ are independently $C_{1-4}$ alkyl groups; s, t, v are integers such that t>0 and s+t+v>3; $R^{11}$ is a terminating radical including H, alkyl, substituted alkyl, aryl and substituted aryl; and values of p & q are ≧0 while the value of r>0.

14. A tissue product as defined in claim 13, wherein the polymer or copolymer comprises:

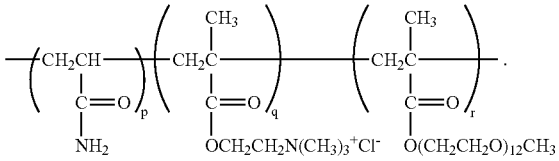

15. A tissue product as defined in claim 7, wherein the polymer or copolymer comprises a poly(ethylene glycol) alkyl ether methacrylate.

16. A tissue product having an improved feel when wet comprising:

a base sheet comprising pulp fibers, the base sheet having a first side and a second and opposite side, the base sheet having a bulk density of at least about 2 cc/g;

a wet anti-friction composition applied to at least one side of the base sheet, the wet anti-friction composition being applied in an amount sufficient for the treated side of the base sheet to have a wet dynamic coefficient of friction that is no more than about 10% greater than the dry dynamic coefficient of friction of the treated side, wherein the wet anti-friction composition comprises a derivatized polyethylene oxide, the polyethylene oxide having a molecular weight of greater than about 20,000.

17. A tissue product as defined in claim 16, wherein the derivatized polyethylene oxide comprises:

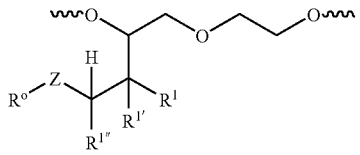

wherein $R^1$, $R^{1'}$, $R^{1''}$ are independently H or a $C_{1-4}$ alkyl;

Z is a bridging radical selected from the groups comprising —O—, —S—, —OOC—, —COO—, —HNOC—, —CONH, and mixtures thereof; and $R^0$ is a moiety containing a functional group selected from the group H, amine, amide, carboxyl, hydroxyl, aldehyde, epoxy, silanol, azetidinium groups, and mixtures thereof.

18. A tissue product as defined in claim 16, wherein the derivatized polyethylene oxide comprises:

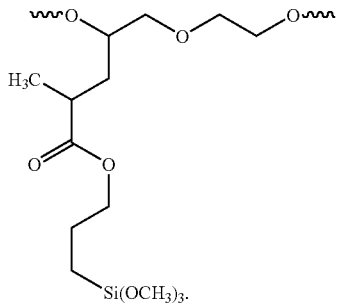

19. A tissue product as defined in claim 16, wherein the derivatized polyethylene oxide has silanol functional groups.

20. A tissue product as defined in claim 16, wherein the derivatized polyethylene oxide forms covalent or ionic bonds with paper fibers.

21. A tissue product as defined in claim 16, wherein the derivatized polyethylene oxide contains from about 0.5 percent to about 25 percent by weight of pendant functional groups.

22. A tissue product having an improved feel when wet comprising:

a base sheet comprising pulp fibers, the base sheet having a first side and a second and opposite side, the base sheet having a bulk density of at least about 2 cc/g;

a wet anti-friction composition applied to at least one side of the base sheet, the wet anti-friction composition being applied in an amount sufficient for the treated side of the base sheet to have a wet dynamic coefficient of friction that is no more than about 10% greater than the dry dynamic coefficient of friction of the treated side, wherein the wet anti-friction composition comprises a polymer or copolymer derived from ethylenically unsaturated monomers wherein at least one monomer comprises a pendant polyalkylene oxide moiety.

23. A tissue product as defined in claim 22, wherein the polymer or copolymer has the structure:

$$-\{-[Q^1]_a-[Q^2]_b-[Q^3]_c-\}_w-$$

wherein:

a and b are integers greater than or equal to 0 c is an integer>0 w is an integer greater than or equal to 1;

$Q^1$ is a monomer unit containing a functionality capable of hydrogen or covalently bonding with cellulose or any other polar or non-polar monomer not containing a pendant polyalkylene oxide functionality;

$Q^2$ is a monomer unit containing a charge functionality;

$Q^3$ is a monomer unit or mixture of monomer units containing pendant polyalkylene oxide functionality wherein said pendant polyalkylene oxide functionality has a degree of polymerization greater than 3; and the ratio of c to (a+b+c) is chosen such that the weight ratio of $Q^3$ to $[Q^1+Q^2+Q^3]$ is from about 5 to 100%.

24. A tissue product as defined in claim 23 wherein the ratio of c to (a+b+c) is chosen such that the weight ratio of $Q^3$ to $[Q^1+Q^2+Q^3]$ is from about 20 to 100%.

25. A tissue product as defined in claim 23 wherein polymer or copolymer has a weight average molecular weight of greater than about 20,000.

26. A tissue product as defined in claim 23 wherein b>0 and $Q^2$ is derived from a monomer unit containing a cationic charge functionality.

27. A tissue product as defined in claim 26 wherein the cationic charge functionality is incorporated via a diallydimethylammonium cationic monomer.

28. A tissue product as defined in claim 22, wherein the polymer or copolymer comprises:

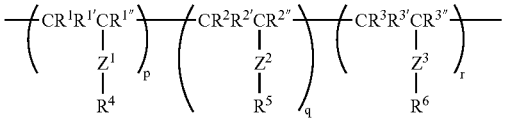

wherein $R^{1'}$, $R^{1''}$, $R^{2'}$, $R^{2'}$, $R^{2''}$, $R^{3'}$, $R^{3'}$, $R^{3''}$ are independently H, or a $C_{1-4}$ alkyl group;

$Z^1$, $Z^2$, $Z^3$ are bridging radicals selected from the group consisting if —CONH—, —NHCO—, —O—, —S—, —CH2—, -aryl-, —COO— or —OOC—, and mixtures thereof; —$R^4$ is any functional group incorporated as part of an ethylenically unsaturated monomer;

$R^5$ is any cationically charged species; and $R^6$ is a polyoxyethylene or polyoxyalkylene derivative of the formula —$(CHR^7CHR^8O)_s$—$(CH2CH2O)_t$—$(CHR^9CHR^{10}O)_v$—$R^{11}$ wherein $R^7$, $R^8$, $R^9$, $R^{10}$ are independently $C_{1-4}$ alkyl groups; s, t, v are integers such that t>0 and s+t+v>3; $R^{11}$ is a terminating radical including H, alkyl, substituted alkyl, aryl and substituted aryl; and values of p & q are ≧0 while the value of r>0.

29. A tissue product as defined in claim 28, wherein the polymer or copolymer comprises:

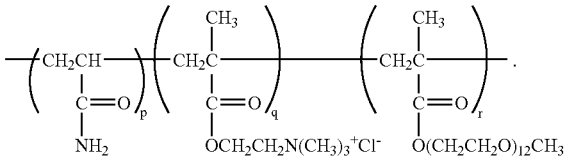

30. A tissue product as defined in claim 22, wherein the polymer or copolymer comprises a poly(ethylene glycol) alkyl ether methacrylate.

31. A tissue product as defined in claim 22, wherein the base sheet has a wet dynamic coefficient of friction that is no more than 3 percent greater than the dry dynamic coefficient of friction of the treated side.

32. A tissue product as defined in claim 22, wherein the base sheet has a wet dynamic coefficient of friction that is no greater than the dry dynamic coefficient of friction of the treated side.

33. A tissue product as defined in claim 22, wherein the wet anti-friction composition is applied to the base sheet in an amount from about 0.03 percent to about 3 percent by weight of fibers contained in the base sheet.

34. A tissue product as defined in claim 22, wherein the wet anti-friction composition has been topically applied to the base sheet.

35. A tissue product as defined in claim 22, wherein the wet anti-friction composition is incorporated into the base sheet during its formation.

36. A tissue product as defined in claim 22, wherein the tissue product has a wet out time of about 20 seconds or less.

37. A treated wiping product having a lower coefficient of friction in the wet state comprising:

a base sheet comprising fibers, the base sheet having a first side and a second and opposite side;

a wet anti-friction composition applied to at least one side of the base sheet, the wet anti-friction composition being applied to the base sheet in an amount sufficient for the treated side of the base sheet to have a lower coefficient of friction in the wet state, the anti-friction composition comprising a derivatized polyethylene oxide in which the polyethylene oxide has a molecular weight of greater than about 20,000 or an acrylate copolymer containing polyethylene oxide moieties.

38. A treated wiping product as defined in claim 37, wherein the wet anti-friction composition comprises a derivatized polyethylene oxide comprising:

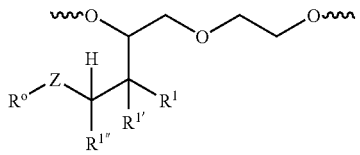

wherein $R^1$, $R^{1'}$, $R^{1''}$ are independently H or a $C_{1-4}$ alkyl;

Z is a bridging radical selected from the groups comprising —O—, —S—, —OOC—, —COO—, —HNOC—, —CONH, and mixtures thereof; and $R^0$ is a moiety containing a functional group selected from the group H, amine, amide, carboxyl, hydroxyl, aldehyde, epoxy, silanol, azetidinium groups, and mixtures thereof.

39. A treated wiping product as defined in claim 38, wherein the derivatized polyethylene oxide forms covalent or ionic bonds with paper fibers.

40. A treated wiping product as defined in claim 38, wherein the derivatized polyethylene oxide contains from about 0.5 percent to about 25 percent by weight of pendant functional groups.

41. A treated wiping product as defined in claim 38, wherein $R^0$ comprises from about one-half percent to about 10 percent by weight of the derivatized polyethylene oxide.

42. A treated wiping product as defined in claim 37, wherein the wet anti-friction composition comprises a derivatized polyethylene oxide comprising:

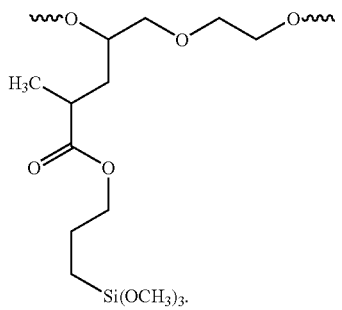

43. A treated wiping product as defined in claim 37, wherein the wet anti-friction composition comprises a derivatized polyethylene oxide derived from ethylenically unsaturated monomers wherein at least one monomer comprises a pendant polyalkylene oxide moiety.

44. A treated wiping product of claim 37, wherein the derivatized polyethylene oxide has the structure:

$$-\{-[Q^1]_a-[Q^2]_b-[Q_3]_c-\}_w-$$

wherein:

a and b are integers greater than or equal to 0 c is an integer >0 w is an integer greater than or equal to 1;

$Q^1$ is a monomer unit containing a functionality capable of hydrogen or covalently bonding with cellulose or any other polar or non-polar monomer not containing a pendant polyalkylene oxide functionality;

$Q^2$ is a monomer unit containing a charge functionality;

$Q^3$ is a monomer unit or mixture of monomer units containing pendant polyalkylene oxide functionality wherein said pendant polyalkylene oxide functionality has a degree of polymerization greater than 3; and the ratio of c to (a+b+c) is chosen such that the weight ratio of $Q^3$ to $[Q^1+Q^2+Q^3]$ is from about 5 to 100%.

45. A treated wiping product as defined in claim 44 wherein the ratio of c to (a+b+c) is chosen such that the weight ratio of $Q^3$ to $[Q^1+Q^2+Q^3]$ is from about 20 to 100%.

46. A treated wiping product as defined in claim 44 wherein the derivatized polyethylene oxide has a weight average molecular weight of greater than about 20,000.

47. A treated wiping product as defined in claim 44 wherein b>0 and $Q^2$ is derived from a monomer unit containing a cationic charge functionality.

48. A treated wiping product as defined in claim 47 wherein the cationic charge functionality is incorporated via a diallydimethylammonium cationic monomer.

49. A treated wiping product as defined in claim 44, wherein the derivatized polyethylene oxide comprises:

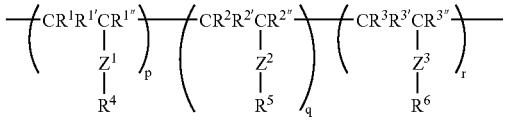

wherein $R^{1'}, R^{1''}, R^{2'}, R^{2''}, R^{2''}, R^{3'}, R^{3'}, R^{3''}$ are independently H, or a $C_{1-4}$ alkyl group;

$Z^1, Z^2, Z^3$ are bridging radicals selected from the group consisting of —CONH—, —NHCO—, —O—, —S—, —CH2—, -aryl-, —COO—, —OOC—, and mixtures thereof; $—R^4$ is any functional group incorporated as part of an ethylenically unsaturated monomer;

$R^5$ is any cationically charged species; and $R^6$ is a polyoxyethylene or polyoxyalkylene derivative of the formula $—(CHR^7CHR^8O)_s—(CH2CH2O)_t—(CHR^9CHR^{10}O)_v—R^{11}$ wherein $R^7, R^8, R^9, R^{10}$ are independently $C_{1-4}$ alkyl groups; s, t, v are integers such that t>0 and s+t+v>3; $R^{11}$ is a terminating radical including H, alkyl, substituted alkyl, aryl and substituted aryl; and values of p & q are ≧0 while the value of r>0.

50. A treated wiping product as defined in claim 44, wherein the derivatized polyethylene oxide comprises:

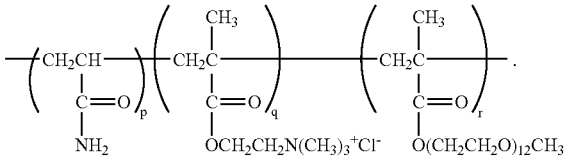

51. A treated wiping product as defined in claim 37, wherein the wet anti-friction composition is applied to the base sheet in a total amount of from about 0.03 percent to about 3 percent by weight.

52. A treated wiping product as defined in claim 37, wherein the wiping product comprises a facial tissue, a bath tissue, or a paper towel.

53. A treated wiping product as defined in claim 52, wherein the treated side of the base sheet has a wet static coefficient of friction that is no more than about 10 percent greater than the dry static coefficient of friction of the treated side.

54. A treated wiping product as defined in claim 52, wherein the treated side of the base sheet has a wet dynamic coefficient of friction that is no more than about 10 percent greater than the dry dynamic coefficient of friction of the treated side.

55. A treated wiping product as defined in claim 37, wherein the base sheet comprises more than one ply.

56. A treated wiping product as defined in claim 37, wherein the wiping product comprises a pre-moistened wipe.

57. A process for producing a treated wiping product having a reduced coefficient of friction in the wet state comprising:

providing a base sheet comprising fibers, the base sheet having a first side and a second and opposite side; and incorporating into the base sheet a wet anti-friction composition, the wet anti-friction composition being incorporated into the base sheet in an amount sufficient such that at least one side of the base sheet has a lower wet static coefficient of friction, the wet anti-friction composition comprising a derivatized polyethylene oxide containing a polyethylene oxide having a molecular weight of at least about 20,000 or an acrylate copolymer containing polyethylene oxide moieties.

58. A process as defined in claim 57, wherein the wet anti-friction composition comprises a derivatized polyethylene oxide comprising:

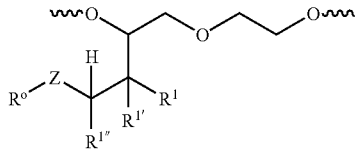

wherein $R^{1}$, $R^{1'}$, $R^{1''}$ are independently H or a $C_{1-4}$ alkyl;

Z is a bridging radical selected from the groups comprising —O—, —S—, —OOC—, —COO—, —HNOC—, —CONH, and mixtures thereof; and $R^{O}$ is a moiety containing a functional group selected from the group H, amine, amide, carboxyl, hydroxyl, aldehyde, epoxy, silanol, azetidinium groups, and mixtures thereof.

59. A process as defined in claim 58, wherein the derivatized polyethylene oxide forms covalent or ionic bonds with paper fibers.

60. A process as defined in claim 58, wherein the derivatized polyethylene oxide contains from about 0.5 percent to about 25 percent by weight of pendant functional groups.

61. A process as defined in claim 57, wherein the wet anti-friction composition comprises a derivatized polyethylene oxide comprising:

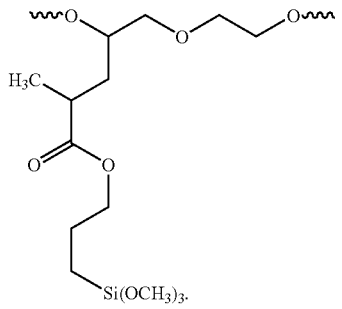

62. A process as defined in claim 57, wherein the wet anti-friction composition comprises a derivatized polyethylene oxide derived from ethylenically unsaturated monomers wherein at least one monomer comprises a pendant polyalkylene oxide moiety.

63. A process as defined in claim 62, wherein the derivatized polyethylene oxide has the structure:

$$-\{-[Q^1]_a-[Q^2]_b-[Q^3]_c-\}w-$$

wherein:

a and b are integers greater than or equal to 0 c is an integer >0 w is an integer greater than or equal to 1;

$Q^1$ is a monomer unit containing a functionality capable of hydrogen or covalently bonding with cellulose or any other polar or non-polar monomer not containing a pendant polyalkylene oxide functionality;

$Q^2$ is a monomer unit containing a charge functionality;

$Q^3$ is a monomer unit or mixture of monomer units containing pendant polyalkylene oxide functionality wherein said pendant polyalkylene oxide functionality has a degree of polymerization greater than 3; and the ratio of c to (a+b+c) is chosen such that the weight ratio of $Q^3$ to $[Q^1+Q^2+Q^3]$ is from about 5 to 100%.

64. A process as defined in claim 63 wherein the ratio of c to (a+b+c) is chosen such that the weight ratio of $Q^3$ to $[Q^1+Q^2+Q^3]$ is from about 20 to 100%.

65. A process as defined in claim 63 wherein the derivatized polyethylene oxide has a weight average molecular weight of greater than about 20,000.

66. A process as defined in claim 63 wherein b>0 and $Q^2$ is derived from a monomer unit containing a cationic charge functionality.

67. A process as defined in claim 66 wherein the cationic charge functionality is incorporated via a diallydimethylammonium cationic monomer.

68. A process as defined in claim 57, wherein the wet anti-friction composition comprises an acrylate copolymer containing polyethylene oxide moieties comprising:

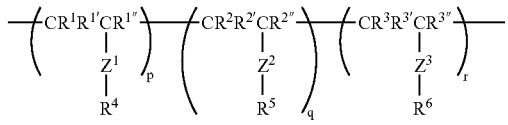

wherein $R^{1'}$, $R^{1''}$, $R^{2}$, $R^{2'}$, $R^{2''}$, $R^{3}$, $R^{3'}$, $R^{3''}$ are independently H, or a $C_{1-4}$ alkyl group;

$Z^1$, $Z^2$, $Z^3$ are bridging radicals selected from the group comprising —CONH—, —NHCO—, —O—, —S—, —CH2—, -aryl-, —COO—, —OOC—, and mixtures thereof; and —$R^4$ is any functional group incorporated as part of an ethylenically unsaturated monomer;

$R^5$ is any cationically charged species; and $R^6$ is a polyoxyethylene or polyoxyalkylene derivative of the formula —$(CHR^7CHR^8O)_s$—$(CH2CH2O)_t$—$(CHR^9CHR^{10}O)_v$—$R^{11}$ wherein $R^7$, $R^8$, $R^9$, $R^{10}$ are independently $C_{1-4}$ alkyl groups; s, t, v are integers such that t>0 and s+t+v>3; $R^{11}$ is a terminating radical including H, alkyl, substituted alkyl, aryl and substituted aryl; and values of p & q are ≧0 while the value of r>0.

69. A process as defined in claim 68, wherein the acrylate copolymer comprises:

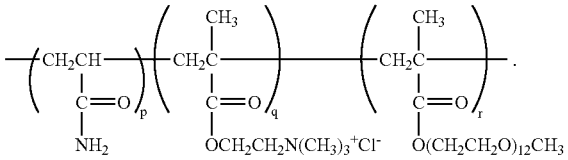

70. A process as defined in claim 68, wherein the acrylate copolymer is incorporated into the base sheet in an amount from about 0.03 percent to about 3 percent by weight of fibers contained in the base sheet.

71. A process as defined in claim 68, wherein the wiping product comprises a facial tissue, a bath tissue, or a paper towel.

72. A process as defined in claim 68, wherein the treated wiping product comprises a premoistened wipe.

73. A process as defined in claim 68, wherein the wet anti-friction composition is incorporated into the base sheet by being topically applied to one side of the sheet.

74. A process as defined in claim 73, wherein the wet anti-friction composition is applied topically to both sides of the base sheet.

75. A process as defined in claim 68, wherein the wet anti-friction composition is incorporated into the base sheet by being added to an aqueous suspension of fibers that is used to form the base sheet.

* * * * *